United States Patent [19]

Kavasilios et al.

[11] 4,141,007

[45] Feb. 20, 1979

[54] CENTRAL ALARM CONDITIONING DETECTING AND ALERTING SYSTEM

[76] Inventors: Michael A. Kavasilios, 3818 Davis Pl., NW., Washington, D.C. 20007; Konstantinos Koutsioukis, 12507 Greenly St., Silver Spring, Md. 20906

[21] Appl. No.: 789,886

[22] Filed: Apr. 22, 1977

[51] Int. Cl.[2] ..... G08B 29/00

[52] U.S. Cl. ..... 340/500; 340/287

[58] Field of Search ..... 340/215, 216, 287, 288, 340/297, 409, 412

[56] References Cited

U.S. PATENT DOCUMENTS

| | | | |
|---|---|---|---|
| 3,441,929 | 4/1969 | Coffer et al. | 340/409 |
| 3,665,461 | 5/1972 | Gnagi et al. | 340/409 |

*Primary Examiner*—Alvin H. Waring

*Attorney, Agent, or Firm*—Burns, Doane, Swecker & Mathis

[57] ABSTRACT

A central smoke detector alarm system, for a multiple floor, multiple dwelling apartment building, which utilizes the existing components of the fire alarm system found in such buildings. Individual alarm condition detectors, such as smoke detectors, are located in each dwelling on a floor and interconnected with each other. A relay box connects the individual units to an existing fire alarm box on that floor to activate the fire alarm system throughout the building should an alarm condition be detected. The relay box serves as a central power supply source for the individual units and contains circuitry to detect a fault in any of the lines interconnecting the individual detectors and the relay box. A time delay is included in the relay box to delay activation of the fire alarm bell a predetermined time period after an alarm condition is detected.

10 Claims, 2 Drawing Figures

CENTRAL ALARM CONDITIONING DETECTING AND ALERTING SYSTEM

BACKGROUND OF THE INVENTION

The preset invention relates to alarm systems for multiple dwelling buildings of the type having a central fire alarm system. More particularly, this invention relates to an alarm system for such buildings wherein the alarm condition detectors are located in the individual dwelling units and are connected so as to alert all the building occupants of a detected alarm condition.

It is clear from some of the tradgic occurrences in multiple dwelling buildings, such as apartments, hotels and condominiums, that existing alarm systems are inadequate for the protection of the building inhabitants. In such buildings, individual smoke and/or fire detection systems installed by the inhabitants in their own dwelling units have become more commonplace. In the typical individual alarm system, the detector sounds an audible alarm to warn the occupants of the particular dwelling in which it is located of the presence of smoke or fire. The range of the warning signal is normally limited to the one dwelling, and such individual alarm systems thus fail to indicate the alarm condition to the occupants of the other dwellings in the building.

It has been proposed in some jurisdictions to require individual alarm condition detectors in each dwelling unit of multiple floor, multiple dwelling buildings, and to require the interconnection of the detectors to a common alarm indicator. One specific proposal involves the use of standard fire and/or smoke detectors in each dwelling unit, individually powered by available electrical power in the individual dwellings. For installation in existing dwelling units, such a system requires the running of wires to the detector from the power source within the dwelling unit, as well as the running of wires from each dwelling to the central alarm. Any one of the detectors may be disconnected from the power source or the alarm within the individual dwelling unit without alerting any of the building occupants or maintenance personnel. Moreover, the alarms on each floor of the building must be interconnected to make the system truly effective, thus necessitating the expensive and time consuming process of making an opening through a floor that is typically a concrete slab.

The same problems exist in installing such a system in a new building, but they are somewhat alleviated by the fact that wires can be run within walls, making them less succeptable to disconnection by the occupants. In addition, the openings between floors can be planned and produced during construction. However, the installation costs are still quite high because of the equipment required, and the system is still unreliable from the standpoint of possible disconnection or failure of individual detector units.

Buildings of the type discussed above are presently provided with manual fire alarm boxes. One alarm box is centrally located on each floor of the building and requires manual actuation to sound the alarm. The alarm boxes on each floor are interconnected so as to sound the alarm throughout the building when one box is actuated. Typically, the alarm boxes are connected to a central annunciator which indicates at a central station in the building which particular alarm box has been activated.

Such systems are, of course, of limited value since they do require manual actuation from outside the dwelling unit, placing a burden on the occupants in a situation of possible panic. Moreover, sounding of the alarm is simultaneous with manual actuation of the alarm box, and therefore does not allow for reset without alarm in case of accidental actuation or testing.

OBJECTS AND BRIEF SUMMARY OF THE INVENTION

Accordingly, it is an object of the present invention to provide a novel method and alarm system that automatically sounds a warning alarm throughout an apartment building upon detection of an alarm condition in any one dwelling on any floor.

It is another object of the invention to provide a novel method and automatic alarm system which couples with the existing components of a conventional fire alarm system to minimize damage and expense during installation, particualrly in existing buildings.

It is a further object of the invention to provide a novel method and alarm system all of the individual alarm condition detector units on a floor and to connect them to the fire alarm box on the floor.

It is yet another object of the invention to provide a novel method and alarm system in which a central source of power for the individual detector units.

It is a further object of the invention to monitor the lines interconnecting the alarm condition detectors and provide an indication of a fault in any one of them so as to maximize system reliability.

It is yet another object of the invention to provide a time delay between detection of an alarm condition and actuation of the fire alarm bell to allow for testing of the system and correction upon accidental triggering of the system.

These and other objects of the invention are accomplished by connecting individual alarm condition detectors in each dwelling on a floor of a building to the central fire alarm box on that floor to form a complete alarm condition detector and alarm system that sounds an alarm throughout the building when an alarm condition is detected in any dwelling unit. The connection on each floor is made through a relay box which is in communication with each of the alarm condition detectors on the floor. Upon receipt of an alarm signal from any one of the detectors, the relay box activates the fire alarm box on that floor after a predetermined time period. Since all the fire alarm boxes are interconnected, an alarm is sounded throughout the building.

In accordance with the illustrated embodiment of the invention, the relay box is connected in parallel with each of the alarm condition detectors, which are in the form of smoke detectors, and includes a central power source for supplying power to the detector unit and the fire alarm box. The relay box also contains a detection circuit for detecting an abnormal condition, such as a break, in any of the lines interconnecting the relay box and the smoke detectors. The fault detector serves as an indicator that the system is working properly and also is a form of theft protection.

DETAILED DESCRIPTION OF THE DRAWINGS

Figure 1:
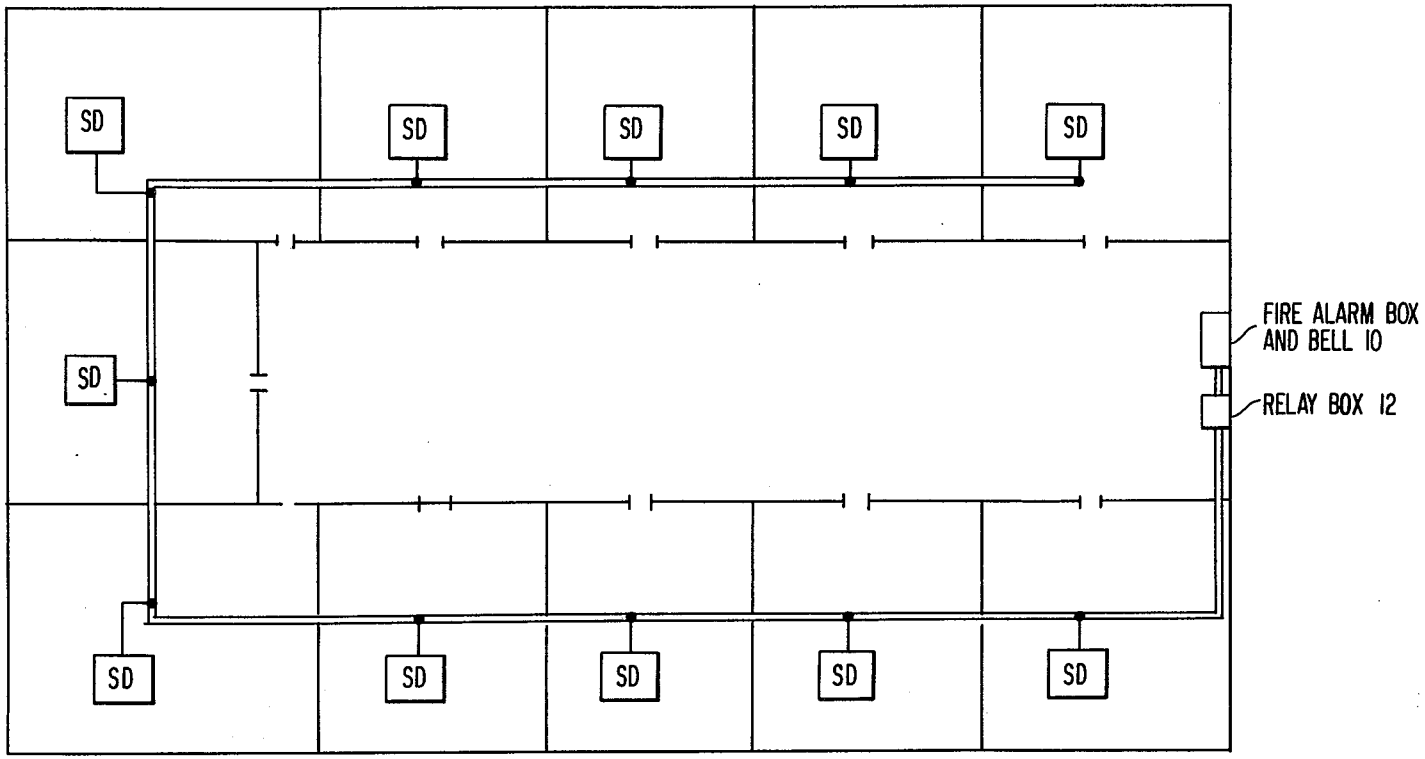
FIG. 1 is a plan view of the one floor of an apartment buidling showing in block form the location of the components of the present invention in relation to an existing fire alarm system.

FIG. 1 shows a simplified version of a typical floor plan of any common multiple floor, multiple dwelling building such as an apartment building. As is well known in multiple family dwellings, a fire alarm box 10 which includes an associated alarm bell is located on each floor. The alarm boxes on each floor, when activated, trigger an alarm throughout the building and may be connected to a central annunicator which indicates at a central station the location of the particular alarm box which has been actuated. Also shown are a plurality of alarm condition detectors such as the illustrated smoke detectors SD, at least one being located in each family dwelling unit. Such detectors are readily available as individual units on the market. Upon detection of an alarm condition such as the presence of smoke or fire, they generate an alarm signal that actuates a buzzer or other audible indicator to transmit a warning signal to the occupants of the unit in which they are located.

In accordance with the present invention, each of the alarm condition detectors on a floor communicates with the fire alarm box through a relay box 12 on that floor. The relay box 12 transmits an alarm signal from any one of the alarm condition detectors to the fire alarm box, to activate the fire alarm throughout the building upon detection of an alarm condition in any one dwelling.

In the preferred embodiment, the alarm condition detectors are interconnected and are connected to the relay box 12 so as to receive power from the relay box and transmit alarm signals thereto. In this embodiment, the relay box further serves to monitor the lines interconnecting the alarm condition detectors SD and provides a fault indication if a break should occur in one of them.

Figure 2:
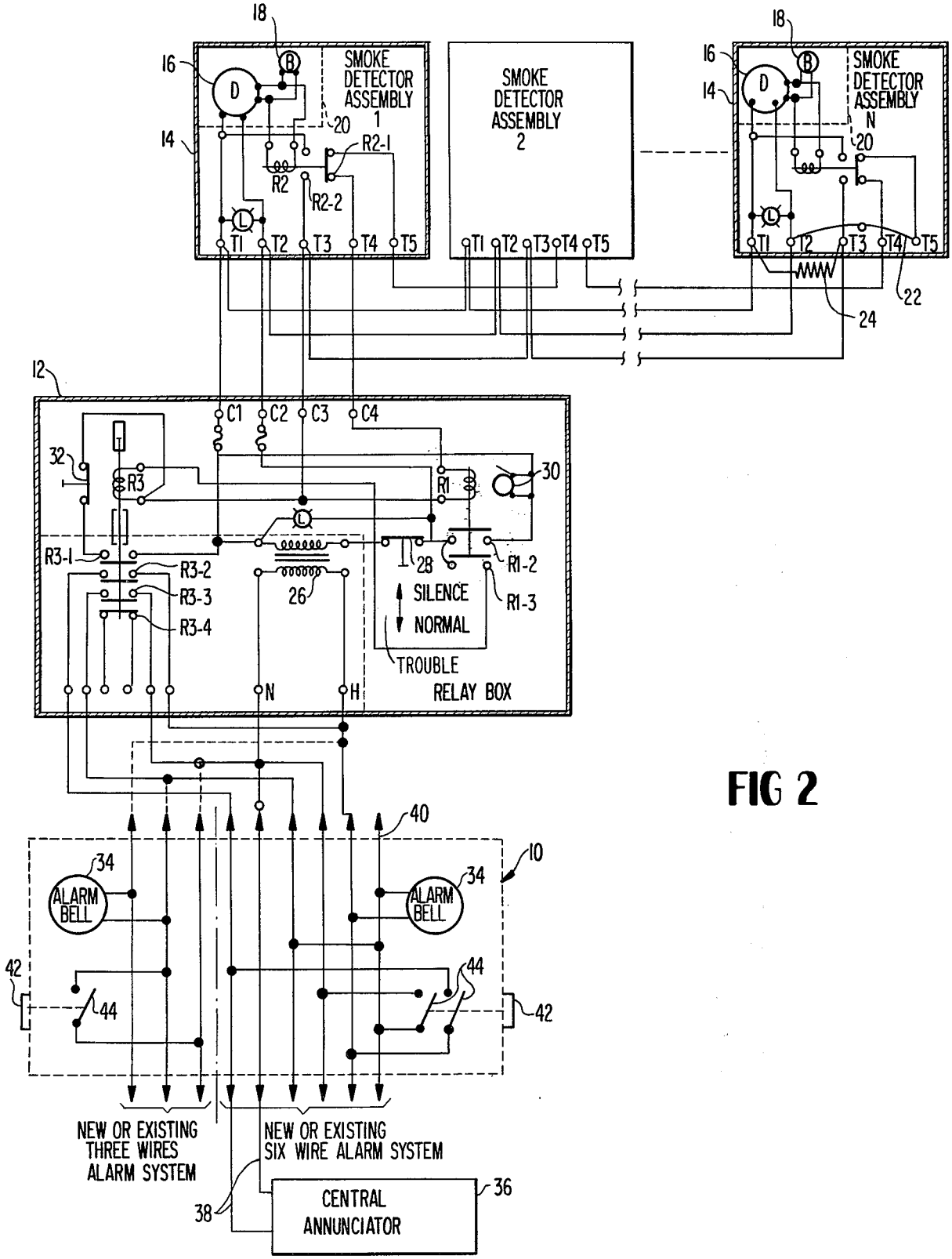
FIG. 2 is a schematic diagram of the circuitry of the alarm system of the present invention.

FIG. 2 illustrates a preferred form of the invention in which the alarm condition detectors are conventional smoke detectors interconnected by wires running between the dwellings and to the relay box 12. Referring now to FIG. 2, a smoke detector assembly SD incorporates within a protective casing 14 a well-known smoke detection circuit 16 and an alarm condition indicator 18 such as a bell, buzzer or light. Upon detection of smoke or fire by the detection circuit 16, the indicator 18 is activated to inform the occupants of an alarm condition. These components, shown within dotted line 20, are commercially available as a single unit.

Each smoke detector assembly has 5 terminals T1–T5 for connection with the other components of the system. Terminals T1 and T2 are respectively connected to each side of a central voltage supply source located within the relay box. They are shunted by an indicator lamp L which serves to indicate that the system is receiving power. Terminal T3 transmits an alarm condition signal to the relay box when such has been detected. The coil of a normally deenergized relay switch R2 is connected in parallel with indicator 18. Upon detection of an alarm condition, relay R2 is energized simultaneously with indicator 18, causing moveable contact R2-1 to connect fixed contacts R2-2, thereby connecting terminal T3 to terminal T1 to transmit an alarm condition signal to the relay box. Terminals T1, T2 and T3 of each of the smoke detector assemblies are connected with each other, respectively, to form parallel connections of the terminals.

Terminals T4 and T5 form a part of the line monitor system, and are normally connected within the smoke detector assembly by moveable contact R2-1 of the relay R2. As can be seen in FIG. 2, terminals T4 and T5 are connected in series between each of the smoke detector assemblies. Their function in the line fault detection operation will be described hereinafter.

The last smoke detector assembly in the chain, labeled N, differs from the other assemblies to accommodate the fault detection system. Terminal T5 is directly connected to terminal T2 via jumper cable 22. Terminals T1 and T3 are connected within the assembly by a resistor 24. The significance of these modifications will become apparent with the description of the line fault detection operation.

The relay box 12 has two input leads, N and H, which are connected to a new or existing emergency 110 volt power source. The input voltage is connected to the primary winding of a transformer 26. A first connection of the secondary winding is connected through a fuse to output terminal C1. The second connection is connected through switch 28 and another fuse to output terminal C2. Output terminals C1 and C2 are respectively connected, in parallel, to input terminals T1 and T2 of each of the smoke detector assemblies and provide the power thereto as previously mentioned. Switch 28 is a main power switch which enables testing of various components, or maintenance, without fear of energizing the alarm when in the open "SILENCE" position. Terminals C1 and C2 are shunted by a lamp L to indicate when the system is receiving power.

The line fault detection system comprises relay R1 and trouble indicator 30, which can be in the form of a bell. One side of the coil of relay R1 is connected to output terminal C3 of the relay box 12. This output terminal is connected in parallel to input terminal T3 of each of the smoke detector assemblies. The other side of the coil is connected to output terminal C4 of relay box 12. This output is connected to the input terminal T4 of the first smoke detector assembly in the chain of assemblies. When the switch 28 is closed, relay R1 is normally energized by virture of its presence in the current path consisting of output terminal C1 of relay box 12, input terminals T1 of each of the smoke detector assemblies, resistor 24 of the last smoke detector assembly N, alarm signal terminal T3, output terminal C3, relay R1, output terminal C4, the series connection of terminals T4 and T5 in each of the smoke detector assemblies, jumper cable 22 in assembly N, voltage source terminal T2, terminal C2, switch 28 and transformer 26. Thus, it can be seen that the current necessary to energize R1 runs through each of the interconnecting lines external to the smoke detector assemblies and the relay box. A break in any one of the lines will deenergize R1, causing moveable contact R1-1 to close the contact R1-2, thereby energizing trouble indicator 30 to indicate that there is a fault in the system.

The alarm condition transmission portion of the relay box consists of a time delay relay R3. This relay operates such that, upon receipt of an actuating signal, closing or opening of the switch contacts is delayed a predetermined time period. The purpose of such a unit, which is known per se, in the relay box is to provide a suitable time period between detection of an alarm condition and indication of the alarm to allow reset of the system if the alarm has been inadvertantly triggered.

A first side of the coil of the time delay relay is connected to one of the contacts R1-3 of relay R1. The second side of the coil is connected to alarm signal terminal C3. The second side of the coil is further connected to voltage source terminal C1 through reset key switch 32 and contacts R3-1 of relay R3. This further current path keeps the relay in a self-hold on state once it has been actuated.

Operation of the system is as follows: In a normal non-alarm state, relays R2 and R3 are normally deenergized. Relay R1 is energized to indicate that there is no fault in the transmission lines as described above.

Upon detection of smoke or fire by detection circuit 16, in any of the smoke detector assemblies, indicator 18 and relay R2 of that assembly are energized. Energization of the relay opens the circuit between terminals T4 and T5 and closes contacts R2-2, thereby connecting terminals T1 and T3. The break in the circuit between terminals T4 and T5 deenergizes relay R1, causing contacts R1-2 and R1-3 to be closed, thereby energizing trouble indicator 30 and connecting the first side of relay R3 to the power source. Connection of terminal T1 and T3 connects the other side of R3 to the power source, thereby actuating the relay. After the 30 second delay introduced by the time delay relay, contacts R3-1, R3-2 and R3-3 are closed, and contacts R3-4 are opened. Closing of contact R3-1 serves to keep the alarm on in case the line connecting terminal T3 to terminal C3 is severed after the alarm has been triggered. The alarm can be reset only by key operated switch 32 to open the circuit, or by deenergizing relay R2 to close the connection of terminals T4 and T5 and reenergize relay R1 if none of the lines have been broken.

As shown in the disclosed embodiment, the relay box is connected to a conventional fire alarm box 10. Closing of contacts R3-2 and R3-3 energizes alarm bell 34 and sends a signal to the central annunciator 36 of the building via lines 38 to indicate which alarm has been triggered. The fire alarm bells on each floor are connected by line 40 to trigger the alarm throughout the building. The alarm box can also be actuated in the conventional manner by pulling handle 42 to close switches 44 and thereby trigger the alarm. Relay box 12 can also be connected to a fire alarm box in which the circuits are normally closed and are actuated upon opening of a switch. This would merely involve connecting contacts R3-4 rather than R3-3.

It can be seen that upon indication of an alarm condition by detector circuit 16, trouble indicator 30 is energized immediately whereas the fire alarm bell 34 is actuated only after the 30 second delay period. This provides a warning and suitable amount of time to reset the system in case of accidental triggerring or testing of the system.

The present invention may be embodied in other specific forms without departing from the spirit or essential characteristics thereof. For example, instead of being combined with the existing components of a conventional fire alarm it may be constructed as a complete new system in itself. Or a wireless system may be employed wherein the relay R2 of each smoke detector assembly is replaced with a transmitter for communication with the relay box.

The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What we claim is:

1. An alarm system for multiple floor buidlings having multiple dwellings on each floor and at least one central fire alarm box on each floor, the system comprising:

an alarm condition detector in each dwelling connected such that an alarm detection in any one of the alarm condition detectors on one particular floor produces an alarm signal at a central location on that one floor; and means for activating the fire alarm box on the one floor in response to the production of the alarm signal at the central location by any one of the alarm condition detectors on the one floor.

2. The alarm system of claim 1 including means for connecting all of the alarm condition detectors on the one floor in parallel so that the detection of an alarm condition by any one of the detectors completes a circuit between two terminals at the central location on the one floor.

3. The alarm system of claim 1 wherein a plurality of the detectors is powered by a central power supply and wherein the system include means for connecting each of the plurality of detectors to the central power supply in parallel and means at the central location for detecting an abnormal condition in any of the connecting means.

4. The alarm system of claim 1 wherein said activating means comprises:

switching means at the central location on the one floor to be activated by the detection of an alarm condition by any of the detectors on the one floor; and means connecting the switching means to the fire alarm box to activate the alarm box in response to activation of the switching means.

5. The alarm system of claim 4 wherein each fire alarm box in the building is connected to an annunicator that provides an indication of the location of an activated fire alarm, and wherein the switching means also includes means for activating the annunciator in response to the detection of an alarm condition.

6. An alarm system for a building having multiple dwellings on a floor and at least one central fire alarm box on the floor, said system comprising:

an alarm condition detector in at least one of the dwellings on the floor, the alarm condition detector producing an alarm signal at a central location on the floor upon detection of an alarm condition;

means for activating the fire alarm box on the floor in response to production of the alarm signal at the central location;

means for connecting said alarm condition detector and said means for activating; and means for detecting an abnormal condition in the connecting means.

7. The alarm system of claim 6 wherein said means for detecting includes an indicator which is activated upon detection of an abnormal condition, said indicator also being activated upon production of an alarm signal at the central location.

8. The alarm system of claim 7, wherein said means for activating includes means to delay activation of the fire alarm box a predetermined time period after production of the alarm signal at the central location.

9. A monitoring device for an alarm system having a plurality of alarm condition detectors, said device comprising:

means at a central location for supplying power to each of the alarm condition detectors over a pair of power lines;

means at the central location for transmitting an alarm signal received from any one of the alarm condition detectors said alarm signal being transmitted from the alarm condition detectors to the central location over a transmission line separate from said pair of power lines;

means for connecting said transmission line in series with said power lines in each of said alarm condition detectors; and coil means at the central location for connecting the transmission line in series with the power lines, for detecting a fault in the transmission or power lines.

10. A method for detecting an alarm condition in a multiple dwelling, multiple floor building and alerting all the occupants of the building to the existence of the alarm condition comprising the steps of:

connecting a plurality of smoke detectors on at least one floor in parallel;

operatively connecting the plurality of smoke detectors to a pre-existing fire alarm box on the floor;

detecting an alarm condition in any one of the multiple dwellings on the floor by means of one of the plurality of smoke detectors and generating an alarm signal indicative of the detected alarm condition;

transmitting the alarm signal to a central location on the floor on which the alarm condition is detected; and in response to receipt of the transmitted alarm signal at the central location, actuating the pre-existing fire alarm box to further actuate a central fire alarm system having interconnected audible alarms on each floor of the building to thereby alert the occupants on each floor of the building to the existence of the detected alarm condition in one of the multiple dwellings.

* * * * *